US008280263B2

(12) United States Patent
Baxter et al.

(10) Patent No.: US 8,280,263 B2
(45) Date of Patent: Oct. 2, 2012

(54) MULTI-FEED DETECTION AND CONTROL SYSTEM

(75) Inventors: Nicholas Baxter, Hertfordshire (GB); Andrew Hill, Hertfordshire (GB); Andrew Ashwood, Hertfordshire (GB); Nicholas Gates, Hertfordshire (GB); Robert Sanders, Hertfordshire (GB); Andrew Williams, Hertfordshire (GB)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/017,081

(22) Filed: Jan. 31, 2011

(65) Prior Publication Data

US 2012/0195667 A1 Aug. 2, 2012

(51) Int. Cl.
*G03G 15/10* (2006.01)

(52) U.S. Cl. ..... 399/16; 399/388; 399/22; 271/10.02; 271/10.03; 271/262; 271/265.04

(58) Field of Classification Search ..... 399/16, 399/388, 397, 391, 401, 22; 271/10.1, 225, 271/184, 10.2, 10.3, 262, 265.04
See application file for complete search history.

(56) References Cited

U.S. PATENT DOCUMENTS

| | | | | |
|---|---|---|---|---|
| 2,892,629 | A | 6/1959 | Osgood, Jr. et al. | |
| 3,895,790 | A | 7/1975 | Hoyer et al. | |
| 4,060,232 | A | 11/1977 | Gibson | |
| 6,674,979 | B2 * | 1/2004 | Nagano | 399/68 |
| 7,080,834 | B2 * | 7/2006 | Asari | 271/176 |
| 7,597,320 | B2 * | 10/2009 | Matsumoto et al. | 271/225 |
| 2007/0045933 | A1 | 3/2007 | Okazaki | |
| 2008/0277863 | A1 | 11/2008 | Matsutomo et al. | |
| 2008/0303206 | A1 | 12/2008 | Ohshima et al. | |
| 2009/0160119 | A1 | 6/2009 | Komuro | |

OTHER PUBLICATIONS

Patents Act 1977: Search Report under Section 17(5); Dated May 25, 2012; GB Application No. 1201293.6.

* cited by examiner

*Primary Examiner* — Matthew G Marini

(57) ABSTRACT

A paper feed system for use in a printing apparatus that detects multi-feeds and separates all sheets while allowing a single sheet to continue into the machine includes a nip with a drive roller for feeding sheets. A reversible pressure roller downstream of the drive roller is connected to a motor, but idles in the direction of the paper feed in normal operation. When a multi-feed is detected, the motor is turned ON and the reversible pressure roll actuated by a controller. The reversible pressure roller has more friction with the sheet in its contact than the friction between sheets. This drives the sheet in contact backwards. This sheet can be diverted to a separate paper path using a gate mechanism and, if desired, fed back into the feed path.

14 Claims, 3 Drawing Sheets

MULTI-FEED DETECTION AND CONTROL SYSTEM

BACKGROUND

1. Field of the Disclosure

This invention relates in general to an image forming apparatus, and more particularly, to an image forming apparatus including a system that that is capable of detecting and separating multi-fed sheets whilst allowing individual single sheets to continue feeding.

2. Description of Related Art

Multi-feeds continue to be a problem when separating and feeding sheets from a stack of sheets within the sheet handling industry. A multi-feed occurs when two or more sheets are fed at once and can cause several problems. Typically, a multi-feed will jam somewhere in a machine, either due to the sheets not moving "as one" or timing issues as the sheets aren't exactly on top of one another so the length of the fed sheet appears longer than the machine expects. If the sheets make it through the whole machine the user can find blank sheets within large print runs, or in the case of duplex printing blank sides. All representations of multi-feed are an annoyance to the user and costly in terms of wasted paper and toner on jobs that need to be re-run, the extra electricity consumed in re-running jobs and the cost of time spent by the user either clearing the jam or re-running the jobs. Reducing the number of multi-feeds experienced will improve the overall user experience. Multiple solutions have been advanced for detecting and separating them. Most of the solutions are only capable of dealing with two sheets fed together.

For example, in U.S. Pat. No. 2,892,629 an arrangement is shown in which one of the two rollers between which the sheets pass is positively driven, but the other roller is a retard roller and is not positively driven. The latter roller is freely rotatable on a shaft and is spring urged to turn in a direction opposite to that of the positively driven roller. When only one sheet is passing between the two rollers, the friction is such as to cause the retard roller to turn in the direction of motion of the sheet and against the spring bias. However, when two sheets are disposed between the two rollers, the first sheet, bearing against the positively driven roller, is advanced while the second sheet is moved to the rear, under the influence of the spring biased retard roller which now rotates in the opposite direction to sheet transfer. U.S. Pat. No. 3,895,790 also uses a retard roller arrangement in which the retard roller is reversed when a multiple feed occurs. The prior art devices use a slip clutch system to provide forward movement when a multiple feed is not present. All of these devices depend upon the relative friction between the positively driven roller and the sheet to be advanced as being greater than the friction between the sheet to be advanced and the sheet or sheets to be returned. In U.S. Pat. No. 4,060,232 a garter spring drive is used to rotate a retard roll in a sheet reversing direction when multiple sheets are in a nip formed by a retard roll and a positively driven separator roll. When one sheet is in the nip, slippage occurs between the garter spring and pulleys so that the retard roll turns with the separator roll in a paper feed direction. All of the patents mentioned hereinbefore are included herein by reference.

Even though these solutions are useful, there is still a need for a multi-feed system that will facilitate detection and separation of more than two sheets while reliably feeding sheets one at a time.

SUMMARY OF THE DISCLOSURE

Accordingly, a system is disclosed that detects multi-feeds and separates all sheets allowing a single sheet to continue into the machine. The system includes a nip with a standard drive roller for feeding sheets. A reversible pressure roller downstream of the drive roller idles in the direction of the paper feed in normal operation. When a multi-feed is detected, the pressure roller is turned ON using appropriate timing. This roller has more friction with the sheet in its contact than the friction between sheets. This drives the sheet in contact backwards. This sheet can be diverted to a separate paper path using a gate mechanism and, if desired, fed back into the sheet stream or feed path.

BRIEF DESCRIPTION OF THE DRAWINGS

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

Referring now to FIG. 1, a conventional electrostatographic machine or printer is represented by block 8. It includes a charge receptor or photoreceptor having an imageable surface and rotatable in a predetermined direction to be uniformly charged by a charging device and imagewise exposed by an exposure device to form an electrostatic latent image on the surface. The latent image is thereafter developed by a development apparatus that, for example, includes a developer roll for applying a supply of charged toner particles to the latent image. The charged toner particles adhere to appropriately charged areas of the latent image. The surface of the photoreceptor then moves to a transfer zone. Simultaneously, a print sheet onto which a desired image is to be printed is drawn from a sheet supply stack of a sheet feeding system and conveyed along a sheet path to the transfer zone.

At the transfer zone, the print sheet is brought into contact with the surface of the photoreceptor, which at this point is carrying toner particles thereon. A corotron at the transfer zone causes the toner image on the photoreceptor to be electrostatically transferred to the print sheet. The print sheet is then forwarded to subsequent stations, as is familiar in the art, including a fusing station to fuse the image to the copy sheet and then to an output tray. The reproduction machine 8 includes a controller or electronic control subsystem (ESS) which is preferably a programmable, self-contained, dedicated mini-computer having a central processor unit. As such, it is the main control system for components and other subsystems including paper feeding in machine 8.

Figure 1:
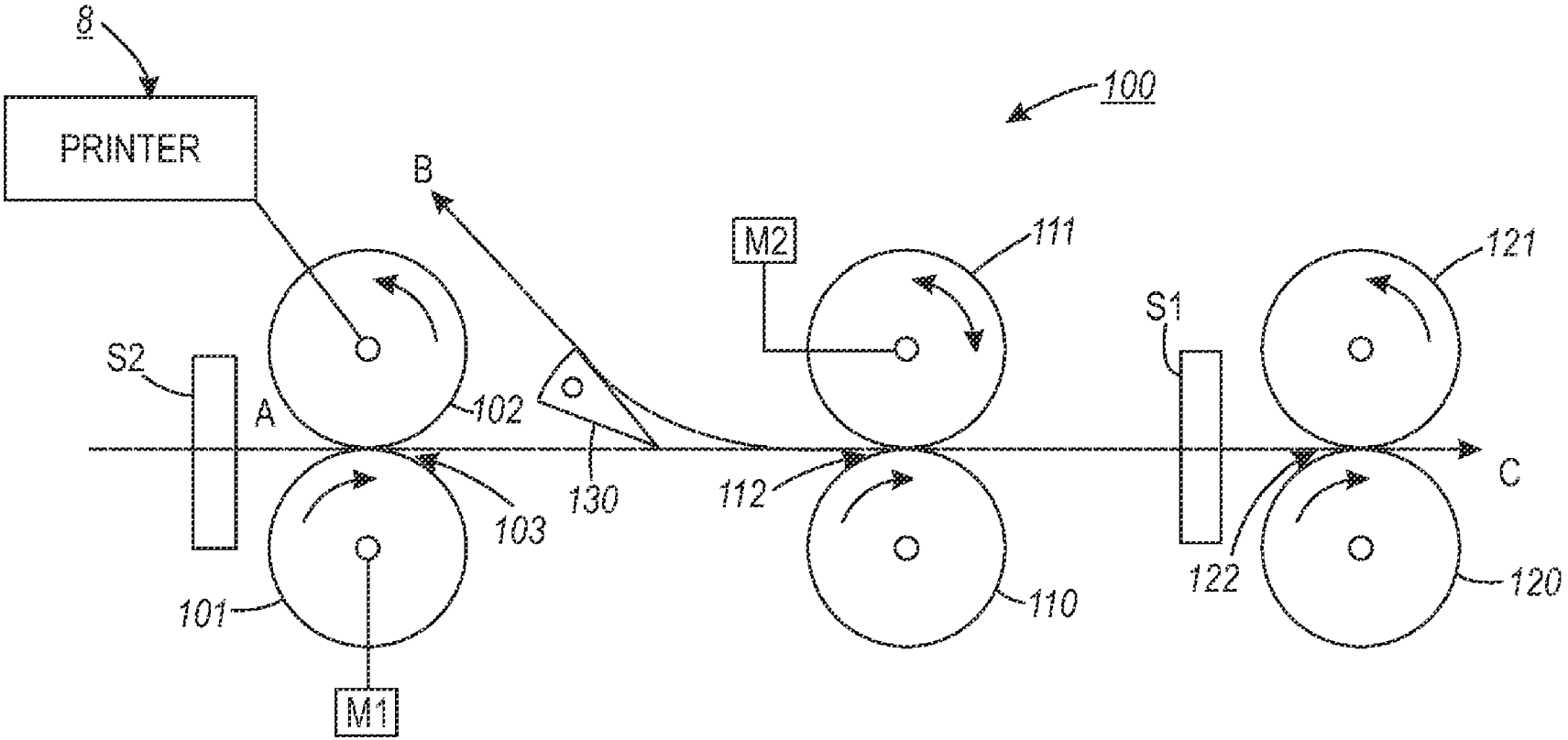
FIG. 1 is a frontal view of a schematic diagram of the multi-feed detection and control system of the present disclosure.

In further reference to FIG. 1, the multi-feed detection and control system 100 of the present disclosure is illustrated in detail and is adapted to detect multi-feeds and separate all sheets while allowing a single sheet to continue into machine 8. As illustrated, multi-feed detection and control system 100 includes a paper path C through which media, including sheets of all types, are conveyed to receive images thereon. A paper or sheet detection sensor S2 is positioned at an entry point A for paper entering a first drive roll nip 103 formed by drive roll 101 and idler roll 102, a second drive roll nip 112 formed by drive roll 110 and reversible roll 111 powered by motor M2, and a third drive roll nip 122 formed by drive roll 120 and idler roll 121. Drive roll 101 has a motor M1 drivingly connected thereto which also drives rolls 110 and 120 in the direction of paper feed. A multi-feed detection sensor S1 is shown positioned downstream of drive nip 112 and upstream of drive nip 122. Multi-feed sensor S1 is preferably an optical sensor; however, any conventional sensor could be used, if desired.

A gravity gate 130 positioned in paper path C, such that, it allows paper to pass under it in the paper feed direction and pass over it in the direction of exit point B when multi-feeds are detected. Ordinarily, drive roller 110 is ON and rotating in the paper feed direction, while reversible roller 111 attached to motor M2 idles against it. When a multi-feed is detected by S1, motor M2 is turned ON which causes roller 111 that is attached to it to rotate in the opposite direction to the paper feed direction. Roller 111 has greater friction with the paper than between the paper sheets, so when a dual-feed occurs roller 111 attached to motor M2 has enough friction to drive the upper sheet backwards into gravity gate 130 while the lower sheet continues to move in the forward direction. The trail edge of the multi-feed must pass gravity gate 130 to allow it to drop before motor M2 is turned ON, therefore, when the multi-fed sheet is fed backwards it exits from the system at point B. To ensure that the remaining "single" sheet is not fed in the wrong direction, roller 111 must have a lower coefficient of friction than drive roller 110 feeding the paper in the correct direction. An advantage to this configuration is that through experimentation it has been found that roller 111 rotating in the opposite direction to the paper feed direction will feed out a single sheet at a time until there is only one remaining which then carries on in the correct direction. Thus, when more than two sheets are fed, roller 111 rotating in the opposite direction to the paper feed direction will feed out a single sheet at a time to exit point B until there is only one remaining which then carries on in the sheet feed direction. Sheets exiting point B can either be conveyed to an output tray or re-fed into paper path C past entry point A to receive images thereon.

Figure 2:
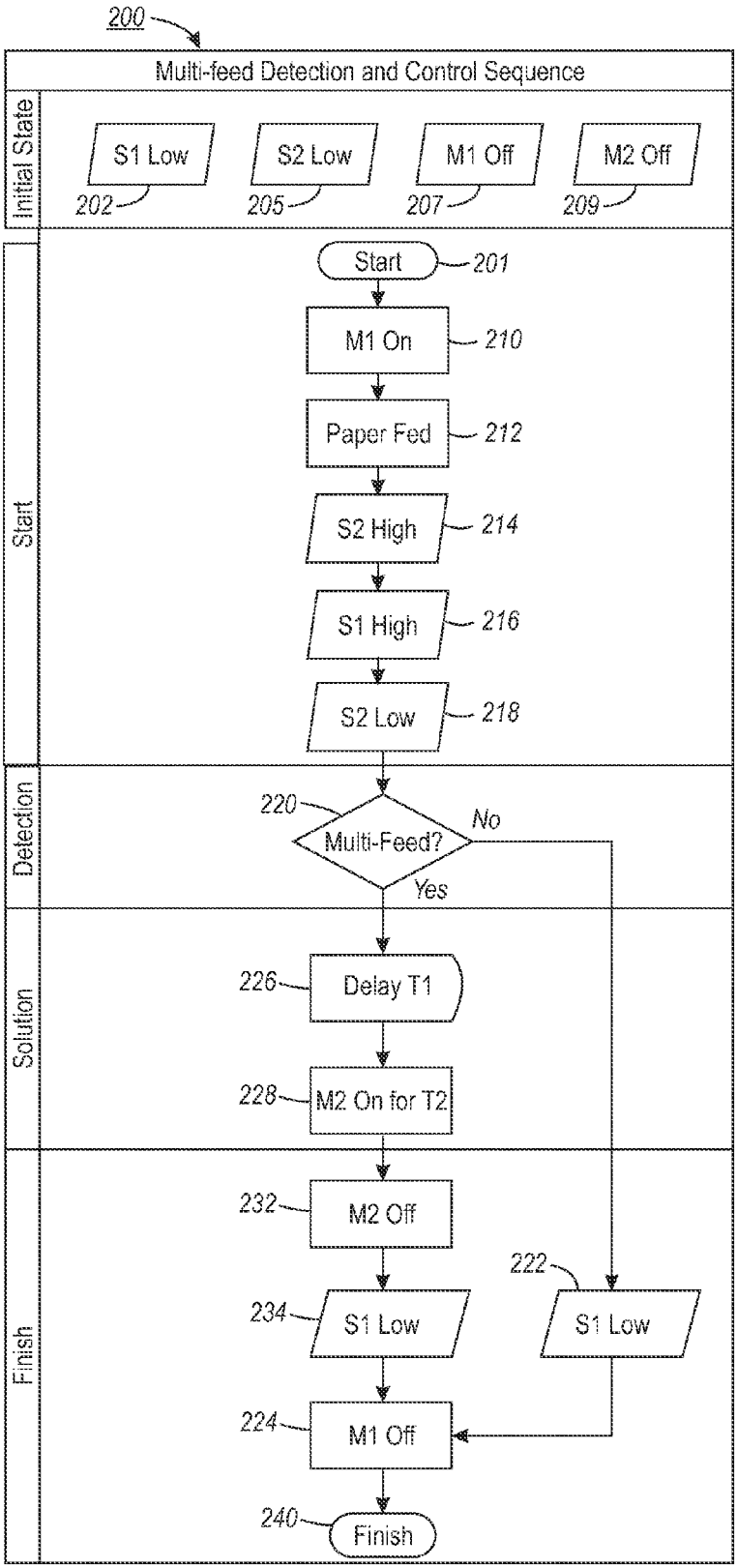
FIG. 2 is a flow chart describing system operation.

A flow chart 200 is shown in FIG. 2 which describes the system operation. That is, in its initial state, sensors S1 and S2 in blocks 202 and 205, respectively, are Low and motors M1 and M2 in blocks 207 and 209 are OFF. But once the start button 201 is pushed, sheets are fed from a paper supply (not shown) and motor M1 in block 210 is turned ON. Paper is fed in block 212, sensor S2 in block 214 is High, sensor S1 in block 216 is High and sensor S2 goes Low in block 218 because in the environment tested (feeding A4 long edge sheets) sensors S1 and S2 were about 200 mm apart, and thus, the trail edge of a sheet would pass through sensor S2 before the system had made a decision. In decision block 220, if no multi-feed is detected sensor S1 is Low and motor M1 is turned OFF in block 224. The job is finished in block 240. However, if a multi-feed is detected in decision block 220, a delay T1 is introduced in block 226 following sensor S2 going low in order to allow for the trail edge of the sheet to pass gravity gate 130. Afterwards, as shown in block 228, motor M2 is turned ON for a predetermined time T2 in order to feed sheet multi-feeds backwards and out of exit point B. Subsequently, motor M2 is turned OFF in block 232, sensor S1 is now Low at block 234 and motor M1 is OFF in block 224 as the lowermost sheet in the multi-feed continues to feed and the job is finish at block 240. If desired, sensor S1 could be omitted and instead a multi-feed sensor placed anywhere prior to the entry point A.

Figure 3:
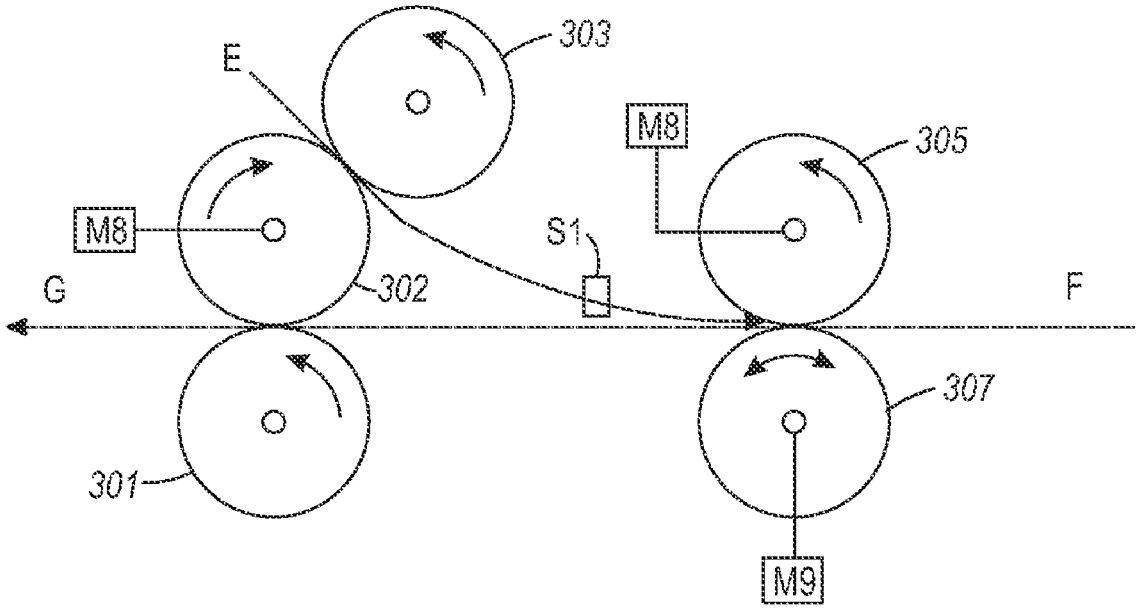
FIG. 3 is an alternative configuration for multi-feed detection and separation.

An alternative embodiment 300 of the present disclosure is shown in FIG. 3 that eliminates the need for gravity gates, but still operates under the same principles of FIG. 1. This configuration includes tri-rollers 301, 302 and 303 positioned upstream of drive roll 305 and reversible roll 307. The tri-rollers are in frictional or geared contact with each other, to provide two spaced-apart nips, one being an input nip formed by rollers (302, 303) to an associated paper path to a downstream imaging device, and the other being an output nip formed by rollers (301, 302) for extracting each sheet of a multi-feed except the uppermost sheet from the paper path. A motor M8 is drivingly attached to drive roll 302 and drive roll 305. A motor M9 is attached to reversible roller 307. The entry point into the system is at E and sheets are directed into paper path F for conveyance to an image transfer station (not shown). When a multi-feed is sensed by sensor S1, reversible motor M9 is actuated and the lower sheet is fed backwards in the direction of point G after the trail edge has dropped down while the upper sheet continues through the system (paper path F) after a predetermined pause for sheets below it to be purged.

In recapitulation, a multi-feed detection and control system has been disclosed that comprises structure and methods configured to separate multi-fed sheets conveyed in a paper path and re-feed the separated sheets into the paper path or drive them into a purge tray. The system includes a reversible roll that idles on a driver roll in the direction of paper feed when single sheets are conveyed, but when a multi-feed is detected the reversible roll is actuated to reverse rotation and drive all sheets above a lowermost single sheet in a reverse and exit direction while the lowermost sheet is delayed for a predetermined time and then fed in the paper feed direction. The system is compatible with paper paths that are vertical, horizontal or inclined at predetermined angles, and it should also be understood that the system could equally be used on any device that feeds media, and not necessarily for marking media, e.g., in automatic teller machines.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A xerographic device adapted to print an image onto a copy sheet includes a system for detecting and separating multi-feeds, comprising:

an imaging apparatus for processing and recording an image onto said copy sheet;

an image development apparatus for developing the image;

a transfer device for transferring the image onto said copy sheet;

a fuser for fusing the image onto said copy sheet; and a copy sheet feeding apparatus including a multi-feed detection and separation system, said multi-feed detection and separation system including a paper detection sensor for detecting the presence of a copy sheet, at least three drive nips for driving copy sheets in a sheet feed direction, a gate supported on a shaft about which said gate is pivoted with said shaft being removed from the vicinity of and positioned downstream of a first of said at least three drive nips, a multi-feed sensor positioned downstream of a second of said at least three drive nips, said multi-feed sensor adapted to sense the presence of multiple copy sheets within said second of said at least three drive nips, said second of said at least three drive nips including a reversible pressure roll adapted to drive uppermost copy sheets of said multiple copy sheets in a direction opposite to said sheet feed direction and then drive the lowermost of said multiple copy sheets in said sheet feed direction.

2. The xerographic device of claim 1, wherein said detection of said multiple copy sheets within said second of said at least three drive nips actuates said reversible pressure roll to drive said uppermost copy sheets in said direction opposite to said sheet feed direction.

3. The xerographic device of claim 2, wherein said paper detection sensor is positioned upstream of a first of said at least three drive nips and at an entry point for copy sheet entering said first of said at least three drive nips.

4. The xerographic device of claim 3, wherein said uppermost copy sheets driven in said opposite direction to said sheet feed direction by said reversible drive roll are driven over said gate which is in a down position.

5. The xerographic device of claim 4, wherein said gate directs said uppermost copy sheets in a direction opposite to said sheet feed direction into an inclined paper path extending over an upper roll of said first of said at least three drive nips.

6. The xerographic device of claim 5, wherein said gravity gate permits sheets to pass under it in said sheet feed direction and over it in said opposite direction.

7. The xerographic device of claim 6, wherein said multiple copy sheets within said second of said at least three drive nips includes at least three copy sheets and feeding of said lowermost copy sheet of said multi-feed is delayed until there is only one copy sheet remaining and then feeding of said lowermost copy sheet is continued.

8. The xerographic device of claim 7, wherein the entry point for copy sheets into the first of said at least three drive nips is in a horizontal plane.

9. The xerographic device of claim 1, wherein said multiple copy sheets within said second of said at least three drive nips includes at least five copy sheets.

10. A multi-feed recovery method in a printing apparatus, comprising:

providing a paper detection sensor for detecting the presence of a sheet;

providing at least three drive nips for driving sheets in a sheet feed direction with a first of said at least three drive nips being positioned immediately downstream of said paper detection sensor;

providing a gate positioned between said first of said at least three drive nips and a second of said at least three drive nips, said gate being supported of a shaft with said shaft being positioned removed from and downstream of said first of said at least three drive nips and upstream of said second of said at least three drive nips;

providing a multi-feed sensor positioned downstream of said second of said at least three drive nips and upstream of a third of said at least three drive nips;

detecting multi-feeds of multiple sheets within said second of said at least three drive nips;

said second of said at least three drive nips including a reversible pressure roll adapted to drive uppermost sheets of said multiple sheets in a direction opposite to said sheet feed direction; and thereafter feeding a lowermost sheet in said multiple sheets in said sheet feed direction.

11. The method of claim 10, including driving said uppermost sheets over said gate which is in a down position by said reversible drive roll.

12. The method of claim 11, wherein said multiple sheets includes at least 3 sheets and feeding of said lowermost sheet of said multi-feed is delayed until there is only one sheet remaining and then feeding of the lowermost sheet is continued.

13. The method of claim 11, including directing said sheets after they have been removed from said second of said at least three drive nips into said first of said at least three drive nips.

14. The method of claim 10, wherein said multi-feed is at least three sheets.

* * * * *